US006935059B1

(12) United States Patent
Chang

(10) Patent No.: US 6,935,059 B1
(45) Date of Patent: Aug. 30, 2005

(54) CRIME SCENE FENCE POST

(75) Inventor: Hungkun James Chang, Hoffman Estates, IL (US)

(73) Assignees: Hungkun J. Chang, Hoffman, IL (US); Chi-Chun A. Chang, Hoffman, IL (US)

( * ) Notice: Subject to any disclaimer, the term of this patent is extended or adjusted under 35 U.S.C. 154(b) by 0 days.

(21) Appl. No.: 10/851,623

(22) Filed: May 22, 2004

(51) Int. Cl.[7] ..... G09F 15/00

(52) U.S. Cl. ..... 40/607.02; 40/607.1; 256/65.11; 256/65.14; 256/1; 49/34

(58) Field of Search ..... 40/607.02, 607.1, 40/607.12; 256/68, 65.11, 65.14, 1; 49/9, 49/34; 160/351; 404/6

(56) References Cited

U.S. PATENT DOCUMENTS

| | | | | | |
|---|---|---|---|---|---|
| 1,041,224 | A * | 10/1912 | Adams | 40/607.02 |
| 3,623,255 | A * | 11/1971 | Girard | 40/607.02 |
| 4,888,894 | A * | 12/1989 | Brown, Jr. | 40/607.02 |
| 5,050,846 | A * | 9/1991 | Goodman et al. | 256/1 |
| 5,931,424 | A * | 8/1999 | Kerber | 248/158 |
| 6,682,055 | B1 * | 1/2004 | Tomlinson et al. | 256/1 |

* cited by examiner

*Primary Examiner*—Gary C. Hoge

(57) ABSTRACT

A crime scene fence post having a post base and an elongated post. The top end of the post has a lead-in notch, a slit, and a slot concatenated along the longitudinal axis of the post for easy installation and hold of a crime scene fence tape. The bottom end of the post has a tenon and the center of the post base has a mortise so that the post and the post base can be joined together to form a self-supported crime scene post.

2 Claims, 4 Drawing Sheets

CRIME SCENE FENCE POST

CROSS-REFERENCE TO RELATED APPLICATIONS

Not applicable.

FIELD OF INVENTION

This invention relates to posts, specifically to such posts which are used for construction of a fence to protecting a crime scene.

BACKGROUND TO THE INVENTION

This invention is directed to a crime scene fence post having a self-supported post base and a post. The top end of the post is designed specifically for easy installation and hold of a crime scene fence tape.

Fence posts are a common item which have been known and used for years in order to retain objects such as animals within a confined area or on the other hand to prevent objects from entering a restricted area. Some fence posts require the post to be driven a part of the way into the ground. Fence rails or fence wires are installed onto the posts thereafter. These fence posts are specifically designed for permanent use in farms and gardens. Some other fence posts have a self-supported base, and one or more cassettes mounted on the posts. The cassette contains a tape wound on a spool. These fence posts are designed for temporary use in controlling pedestrian traffic.

Normally a crime scene is surrounded by a crime scene fence tape which is tied to the objects such as trees or parking meters. The fence tape is thrown away after use since there is a possibility of contamination from the crime scene. Therefore, the fence tape is made of plastic or other inexpensive materials. Often there is no suitable object nearby for tying the fence tape. Therefore, the farm or garden posts will be deployed for the crime scene protection. However, installation of the farm or garden posts requires tools or equipment to drive the posts into the ground. Sometimes, it is difficult to drive the posts into a hard ground surface, for an example, a concrete parking lot. Or, sometimes, it is costly to repair the holes made by the posts driven into a wood or marble floor. An alternative is to use the pedestrian traffic control posts. However, the pedestrian traffic control posts are designed for reuse, for an example, at airport check-in areas. In such controlled environments, the pedestrian traffic control post requires little maintenance. But a crime scene could be outdoors and possibly expose to snow, rain or sunshine. It will require routine maintenance for the cassettes, tapes and the spool mechanism of the pedestrian traffic control posts. In addition, because of the complexity of the tape spool mechanism, the reusable tapes, and the durable self-supported post, the pedestrian traffic control posts are too expensive for the application of protecting a crime scene. Especially, because of possible contamination, it will be costly to throw away the pedestrian traffic control posts after the use.

DESCRIPTION OF THE PRIOR ART

The following U.S. Patents are found which relate to fence posts and as such are exemplary of the U.S. Prior art.

U.S. Pat. No. 3,957,250 to Murphy discloses a fence post that has pins outwardly extending at right angles to each other from the lower portion of the post which is to be buried in the ground and a plurality of holes spaced vertically from each other to receive clips, bolts or other devices for securing strands of wire in the upper portions.

U.S. Pat. No. 4,542,885 to Rossiter shows a fence post that receives wooden fence rails. The lower portion of the post needs to be buried in the ground.

U.S. Pat. No. Des. 377,534 to Bynum illustrates a fence post with a sharp driving tip at the bottom end of the fence post.

U.S. Pat. No. 4,795,137 to Witt discloses a fence post that has a plurality of triangularly flanged fins which will be driven into the ground.

U.S. Pat. No. 6,595,496 B1 to Langlie et al discloses a fence post assembly, as well as a fencing system and related method utilizing the fence post assembly to form a temporary enclosure.

U.S. Pat. No. 6,375,164 B1 to Siegler et al discloses a double-tape pedestrian traffic control device including a self-supported post and two cassettes mounted on the post. Each cassette contains a tape wound on a spool.

SUMMARY

In accordance with the present invention a fence post comprises a self-supported post base and a post. The top end of the post is designed specifically for easy installation and hold of the crime scene fence tape.

Objects and Advantages

This invention relates to posts, and more particularly, to a crime scene fence post. The principal object of this invention is to provide a crime scene fence post, which will have a self-supported base, and will retain the crime scene fence tape in place at the top end of the post.

Another object of this invention is to provide a crime scene fence post, which will be easier to use than such posts of the prior art. That is, the crime scene fence posts can be assembled and installed without any tools or equipment.

A further object of this invention is to provide a crime scene fence post, which does not need to be driven a part of the way into ground. Therefore, the crime scene fence post can be deployed anywhere regardless the location of the crime scenes, for examples, a concrete parking lot, wood floors, etc.

Other objects are to provide a crime scene fence post, which is easy to manufacture, rugged in construction, and inexpensive to be thrown away after usage.

REFERENCE NUMBERALS IN THE DRAWINGS

Figure 1:
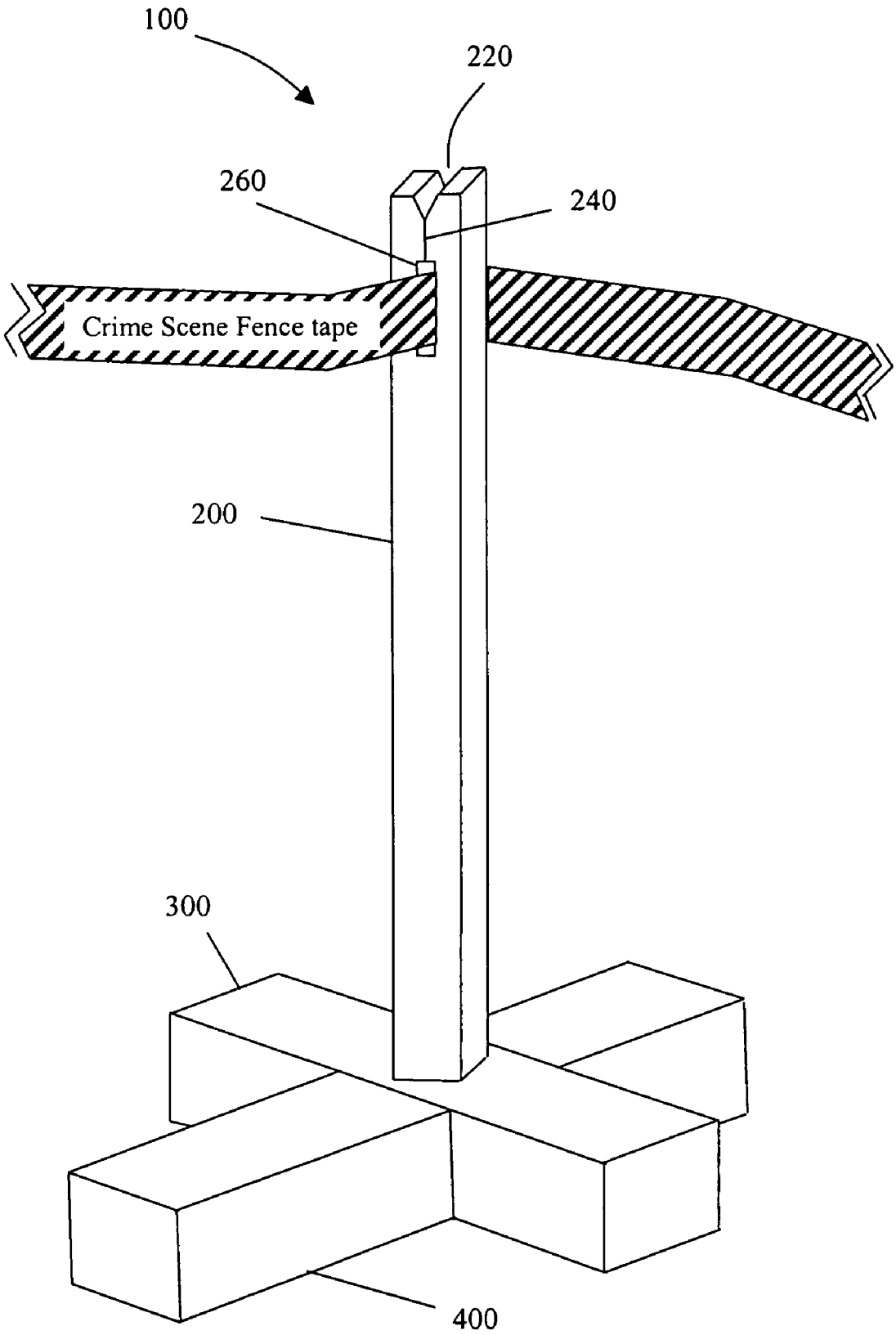
FIG. 1 is a schematic perspective view of the crime scene fence post according to the present invention.

100 crime scene fence post
200 post body
220 lead-in notch
240 slit

260 slot
280 post tenon
300 post base top
320 base top mortise
340 base top recess
400 post base bottom
420 base bottom mortise
440 base bottom recess

DESCRIPTION OF THE PREFERRED EMBODIMENT

Referring now to the drawings in which like numerals refer to like elements of the invention, as seen in FIG. 1, a crime scene fence post 100 comprises a post body 200, a post base top 300 and a post base bottom 400.

Figure 3:
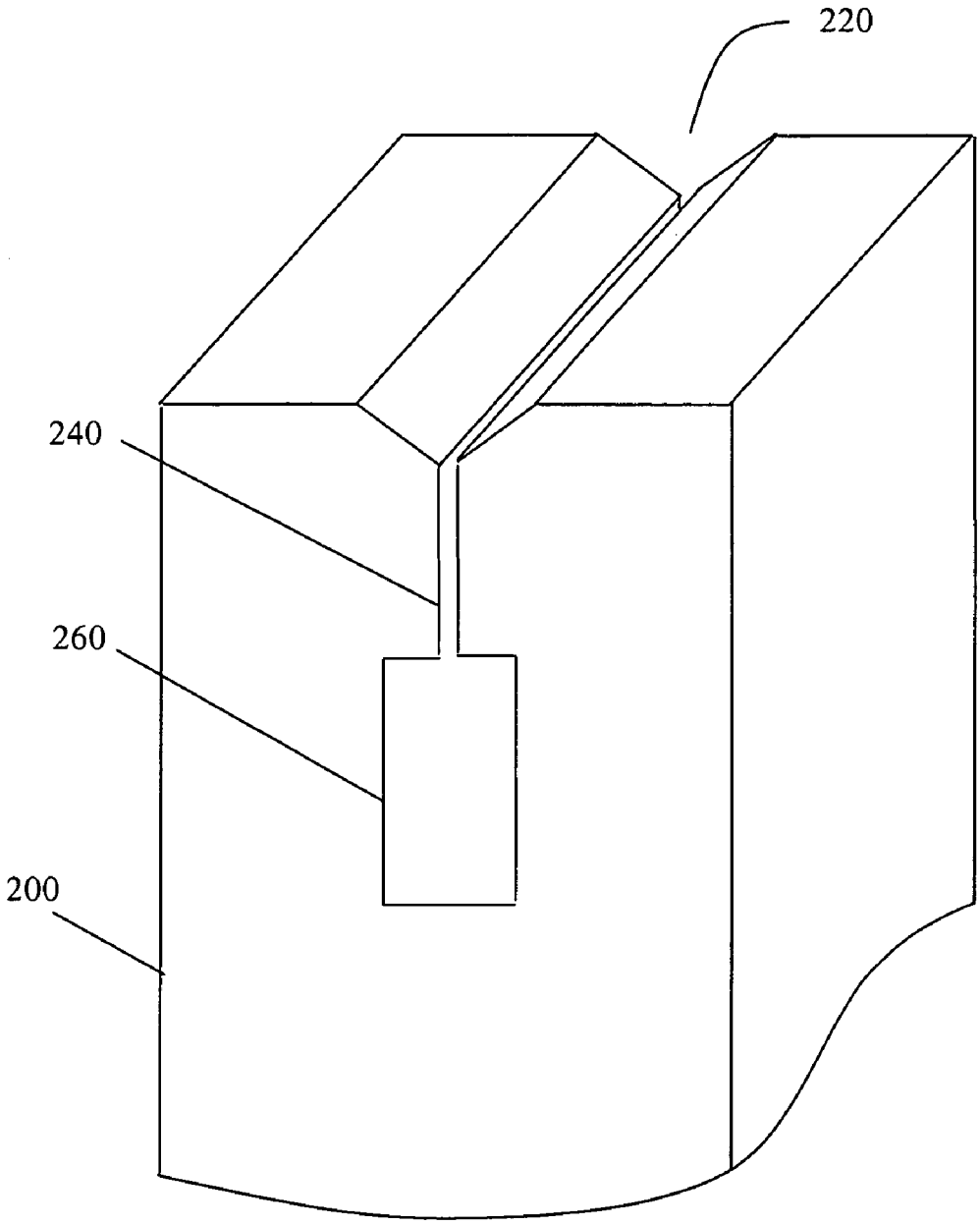
FIG. 3 is a schematic perspective view of the top section of the crime scene fence post of the present invention.

As seen in FIG. 3, the top end of post body 200 has a lead-in notch 220, a slit 240 and a slot 260. Lead-in notch 220, slit 240 and slot 260 are concatenated to form a groove along the longitudinal axis of the elongated post body 200; thereby a crime scene fence tape can be easily inserted through lead-in notch 220, slit 240, and finally placed into slot 260. Since slit 240 is a narrow cut passage the crime scene fence tape will be kept inside slot 260.

Figure 2:
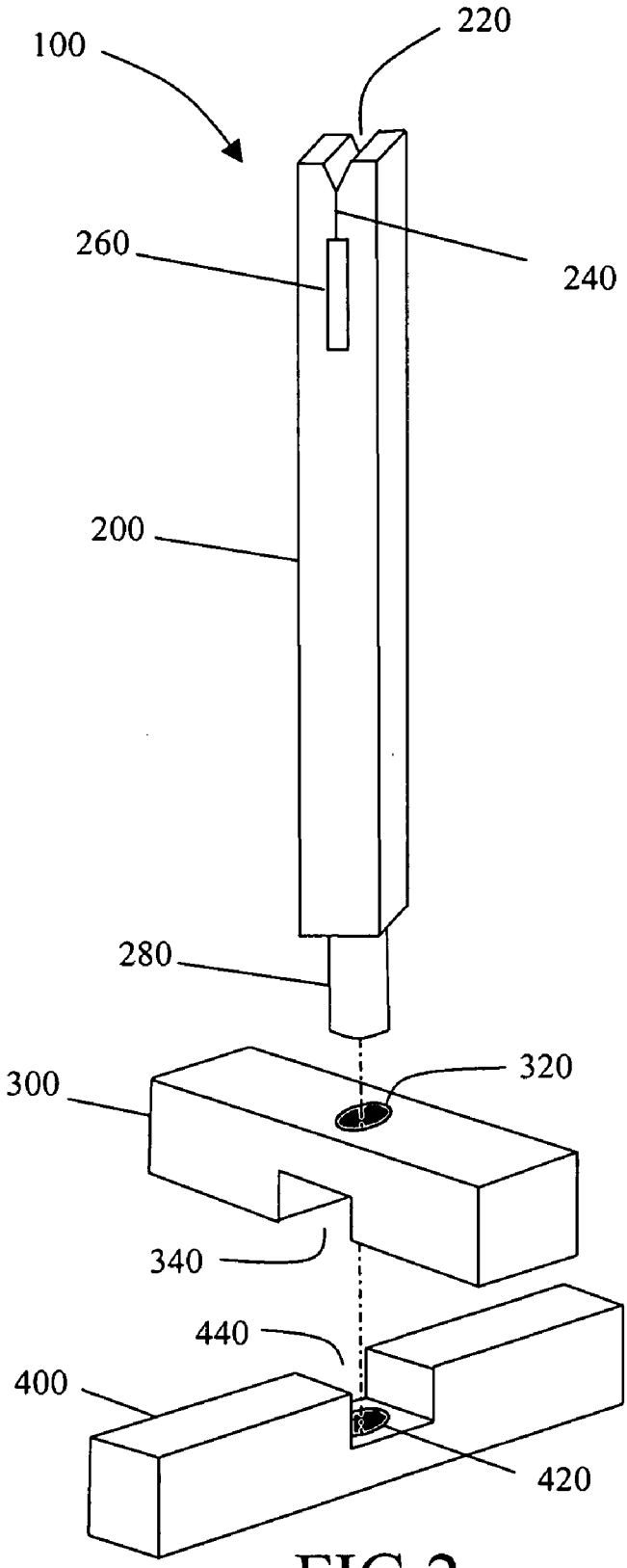
FIG. 2 is a schematic perspective view of the components of the crime scene fence post of the present invention.

As seen in FIG. 2, the bottom end of post body 200 has a post tenon 280. Post tenon 280 will be fitted into base top mortise 320 and base bottom mortise 420 so that post body 200, post base top 300 and post base bottom 400 can be joined together to form a self-supported crime scene fence post 100.

As seen in FIG. 2, post base top 300 is a three-dimensional rectangular object. The center portion of post base top 300 has a through base top mortise 320 and a base top recess 340 facing downward. And post base bottom 400 is a three-dimensional rectangular object as well. The center portion of post base bottom 400 has a through base bottom mortise 420 and a base bottom recess 440 facing upward. The self-supported post base is formed when the facing downward base top recess 340 of post base top 300 is placed at right angles across the facing upward base bottom recess 440 of post base bottom 400. Thereby, base top mortise 320 is lined up with base bottom mortise 420. Therefore, post tenon 280 of post body 200 can be inserted into base top mortise 320 and base bottom mortise 420 to join post body 200, post base top 300 and post base bottom 400 together as seen in FIG. 1.

DESCRIPTION OF THE ALTERNATIVE EMBODIMENT

Figure 4:
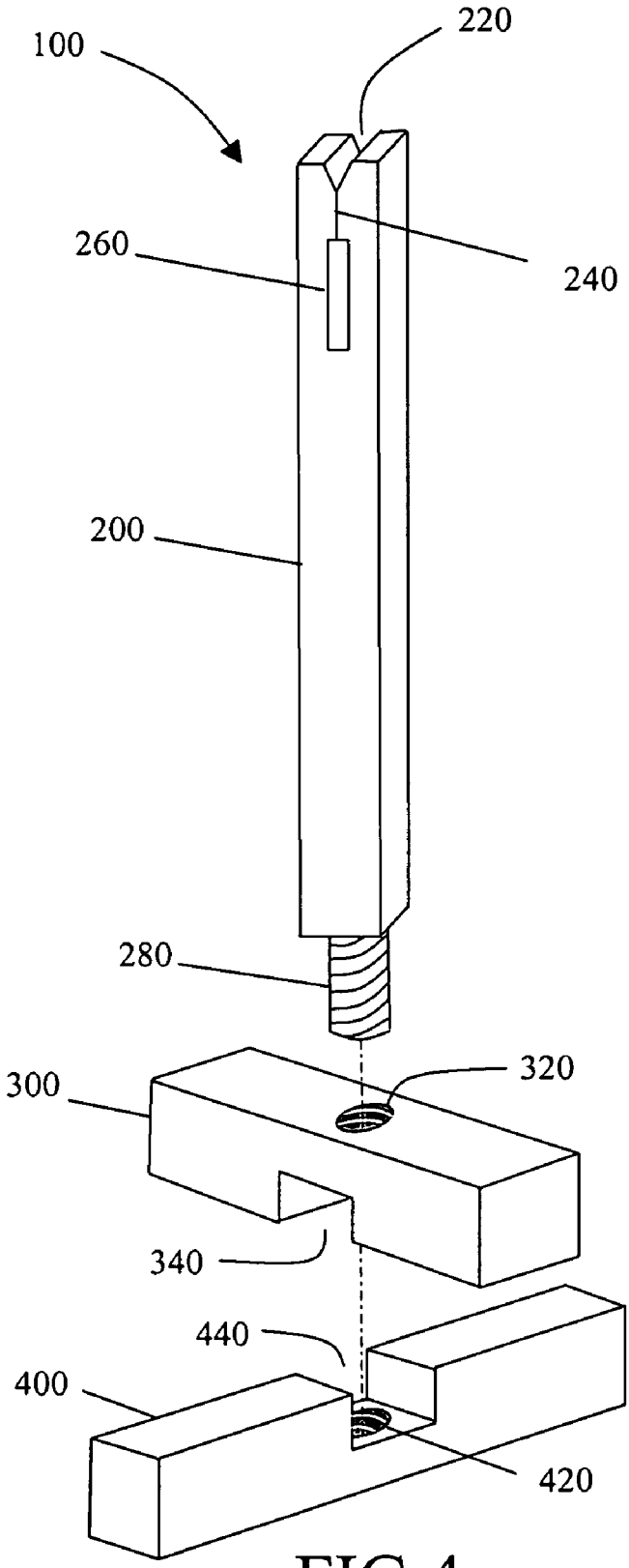
FIG. 4 is a schematic perspective view of the components of the crime scene fence post of the present invention. The post tenon having mating male threads. Both base top mortise and base bottom mortise having mating female threads.

There are various possibilities with regard to post tenon 280, base top mortise 320 and base bottom mortise 420. FIG. 4 shows post tenon 280 having mating male threads, and both base top mortise 320 and base bottom mortise 420 having mating female threads. Thereby, post tenon 280 of post body 200 can be screwed into base top mortise 320 and then, base bottom mortise 420. Thereby, post body 200, post base top 300, and post base bottom 400 are screwed together to form crime scene fence post 100 as seen in FIG. 1.

CONCLUSION

Accordingly, the reader will see the advantages of the crime scene fence post of this invention:

The crime scene fence post of this invention can be assembled and disassembled without any tools or equipment.

The crime scene fence post of this invention allows the crime scene fence tape to be added easily and quickly to the top end of the crime scene fence post to form a crime scene fence.

The crime scene fence post of this invention can be installed anywhere without being driven a part of the post into the ground. Therefore, there will be no damage at the crime scene floor.

The crime scene fence post of this invention can be used to construct a crime scene fence easily and quickly. Also, the crime scene fence can be torn down easily and quickly thereafter.

The crime scene fence post of this invention is easy to manufacture, rugged in construction, and inexpensive to be ridded of after usage.

I claim:

1. A crime scene fence post comprising:

a. an elongated post body and a self-supported post base; said elongated post body having a groove at the top end of said elongated post body; said elongated post body having a post tenon at the bottom end of said elongated post body; said self-supported post base having a base mortise at the center of said self-supported post base;

b. said top end of said elongated post body having said groove; said groove is a combination of a lead-in notch, a slit, and a slot; said lead-in notch, said slit, and said slot are concatenated to form said groove along the longitudinal axis of said elongated post body; thereby a crime scene fence tape can be easily inserted through said lead-in notch, then, said slit, and finally placed into said slot; said slit is a narrow cut passage; thereby said crime scene fence tape will be retained inside said slot;

c. said bottom end of said post body having said post tenon; thereby, said post tenon becoming an extension of said bottom end of said elongated post body; said post tenon will be fitted into said base mortise of said self-supported post base;

d. said self-supported post base having a post base top and a post base bottom; said post base top is a three-dimensional rectangular object;

the center portion of said post base top having a through base top mortise and a base top recess facing downward; said post base bottom is a three-dimensional rectangular object; the center portion of said post base bottom having a through base bottom mortise and a base bottom recess facing upward; said self-supported post base is formed when said base top recess of said post base top is placed at right angles across said base bottom recess of said post base bottom; thereby, said through base top mortise is lined up with said through base bottom mortise to form said base mortise; thereby, said post tenon of said elongated post body can be inserted into said base top mortise and then, said base bottom mortise; thereby, said elongated post body, said post base top and said post base bottom are joined together to form said crime scene fence post.

2. A crime scene fence post as defined in claim 1 wherein; said post tenon having mating male threads; said base top mortise and said base bottom mortise having mating female threads; thereby, said post tenon of said elongated post body can be screwed into said base top mortise and then, said base bottom mortise; thereby, said elongated post body, said post base top and said post base bottom are screwed together to form said crime scene fence post.

* * * * *